US008856965B1

(12) United States Patent
Theofield

(10) Patent No.: US 8,856,965 B1
(45) Date of Patent: Oct. 14, 2014

(54) SHIRT SYSTEM WITH SEALED GLOVE AND SLEEVE

(71) Applicant: Michael J. Theofield, Kings Park, NY (US)

(72) Inventor: Michael J. Theofield, Kings Park, NY (US)

( * ) Notice: Subject to any disclaimer, the term of this patent is extended or adjusted under 35 U.S.C. 154(b) by 142 days.

(21) Appl. No.: 13/622,515

(22) Filed: Sep. 19, 2012

(51) Int. Cl.
*A41B 1/00* (2006.01)
*A41D 27/10* (2006.01)

(52) U.S. Cl.
CPC .. *A41B 1/00* (2013.01); *A41D 27/10* (2013.01)
USPC ..... 2/125; 2/84; 2/270

(58) Field of Classification Search
CPC . A41D 15/00; A41D 19/0041; A41D 19/044; A41D 27/10; A41D 1/02; A42B 1/00; A42B 1/08
USPC ..... 2/270, 269, 125, 123, 158, 159, 84, 85, 2/93, 108, 115, 69
See application file for complete search history.

(56) References Cited

U.S. PATENT DOCUMENTS

| | | | | |
|---|---|---|---|---|
| 1,296,966 | A | 3/1919 | Kaufman | |
| 2,136,879 | A | 11/1938 | Haber et al. | |
| 2,226,066 | A * | 12/1940 | Moe | 2/270 |
| 2,274,510 | A * | 2/1942 | Wohl et al. | 2/270 |
| 2,421,848 | A * | 6/1947 | Philipps | 2/270 |
| 2,507,322 | A * | 5/1950 | Smith | 2/97 |
| 2,675,554 | A | 4/1954 | Gertz | |
| 3,214,771 | A * | 11/1965 | Treiber | 2/270 |
| 3,889,297 | A | 6/1975 | Jarboe et al. | |
| 4,297,746 | A * | 11/1981 | Zarbos | 2/108 |
| 4,756,027 | A * | 7/1988 | Buenos et al. | 2/123 |
| 5,073,988 | A | 12/1991 | Lewis, Jr. et al. | |
| 5,749,098 | A | 5/1998 | Evans | |
| 5,953,758 | A * | 9/1999 | Foster | 2/268 |
| 6,128,785 | A | 10/2000 | Sommeregger | |
| 6,237,152 | B1 | 5/2001 | Gootrad | |
| D449,422 | S | 10/2001 | Massie | |
| 7,296,302 | B2 * | 11/2007 | DeLorenzo et al. | 2/84 |
| 2006/0075538 | A1 * | 4/2006 | Anderson et al. | 2/69 |
| 2009/0049580 | A1 | 2/2009 | Wilson | |
| 2012/0060256 | A1 * | 3/2012 | Parker | 2/85 |

* cited by examiner

*Primary Examiner* — Amy Vanatta

(57) ABSTRACT

A shirt system for providing gloves as extensions of the sleeves to help prevent the leaking of snow, water, or other debris and to help provide protection for a user's torso, hands, wrist, and arms featuring a shirt component with two sleeves and two gloves extending from the sleeves. Slits are disposed in the sleeves allowing a user to remove his/her hands from the gloves and sleeve. Pockets are disposed on the sleeves near the gloves, wherein the pockets are adapted to house the gloves when not in use.

10 Claims, 5 Drawing Sheets

Pullover Version

Zipper version

Inside of sleeve (Front View)

(Back View-
Jacket with hood

SHIRT SYSTEM WITH SEALED GLOVE AND SLEEVE

BACKGROUND OF THE INVENTION

Snow, rain, and other debris can enter into the sleeves of coats or jackets, even when an individual is wearing gloves. The present invention features a shirt system with gloves extending from the sleeves. The gloves can be removed from the user's hands and, while remaining attached to the sleeves, can be secured in a pocket. The shirt system can be worn underneath a coat or jacket and/or another pair of gloves. The system provides a barrier so as to help prevent the leaking of snow, water, or other debris into the sleeve.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-4, the present invention features a shirt system (100) that provides a seal between gloves and its wrist portion of the sleeve to help prevent the leaking of snow, water, or other debris. The system (100) can help provide protection for a user's torso, hands, wrist, and arms.

Figure 1:
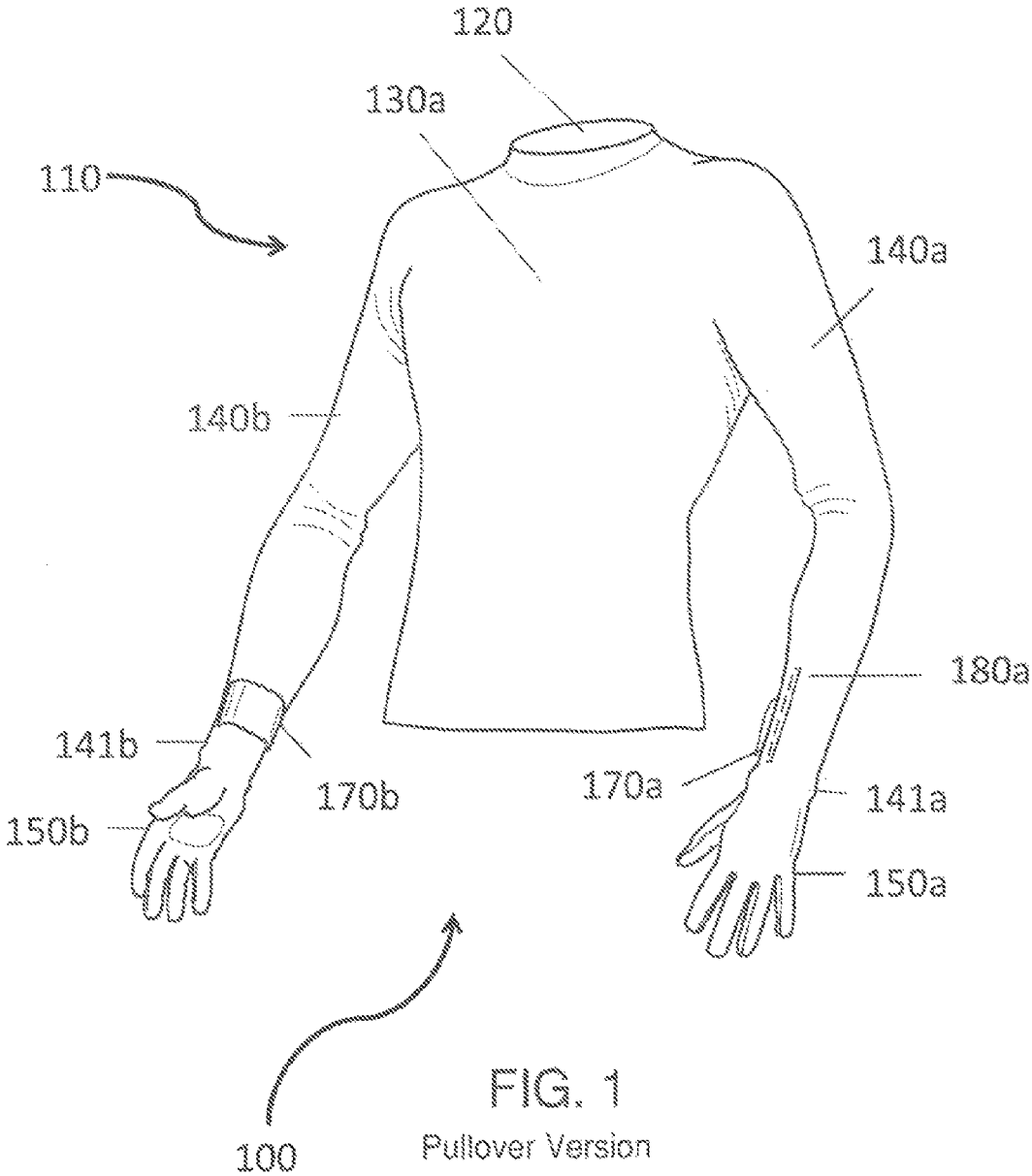
FIG. 1 is a perspective view of the system of the present invention (a pullover version).
Figure 1A:
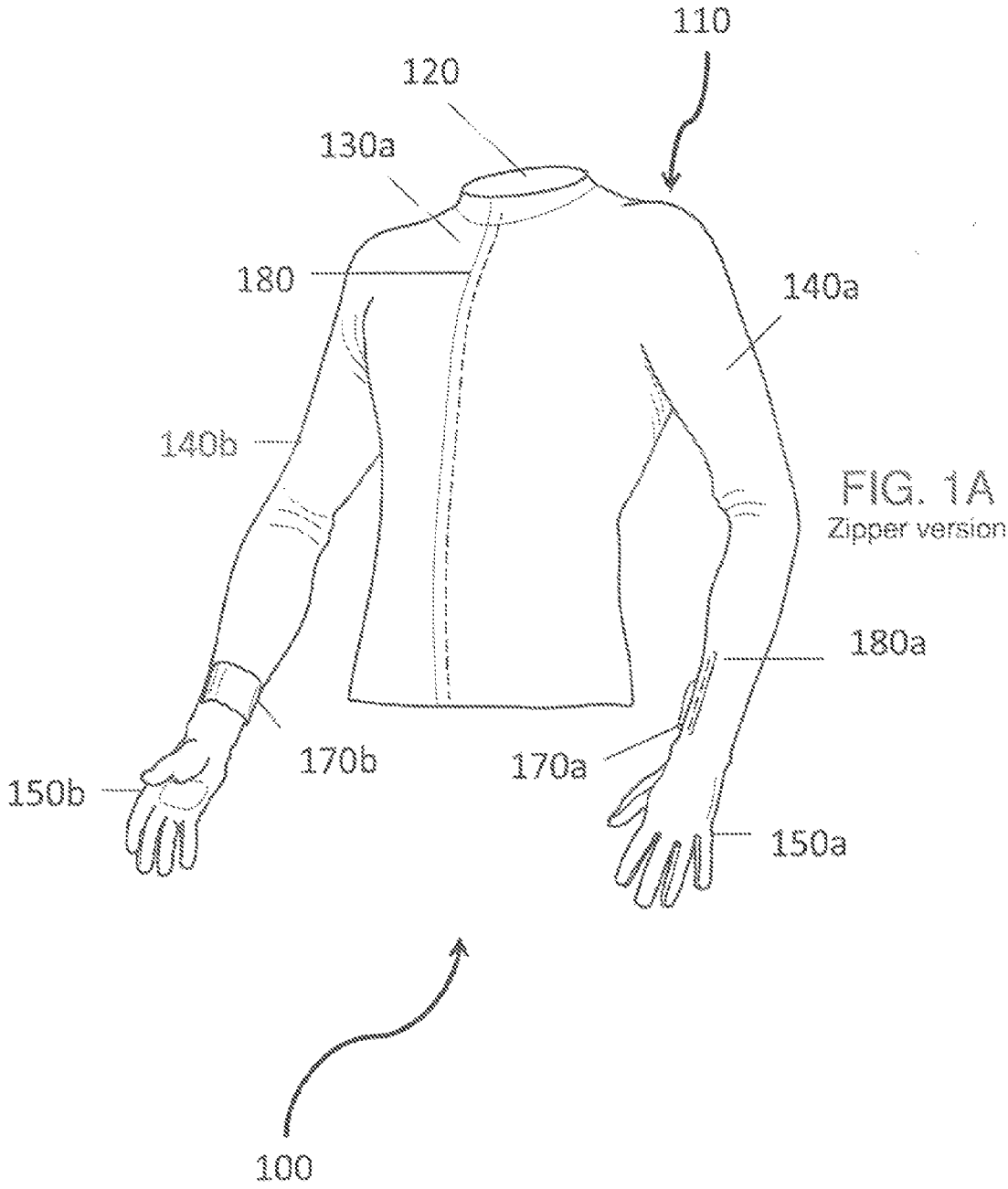
FIG. 1A is a perspective view of an alternative embodiment of the present invention (a zippered version).
Figure 3:
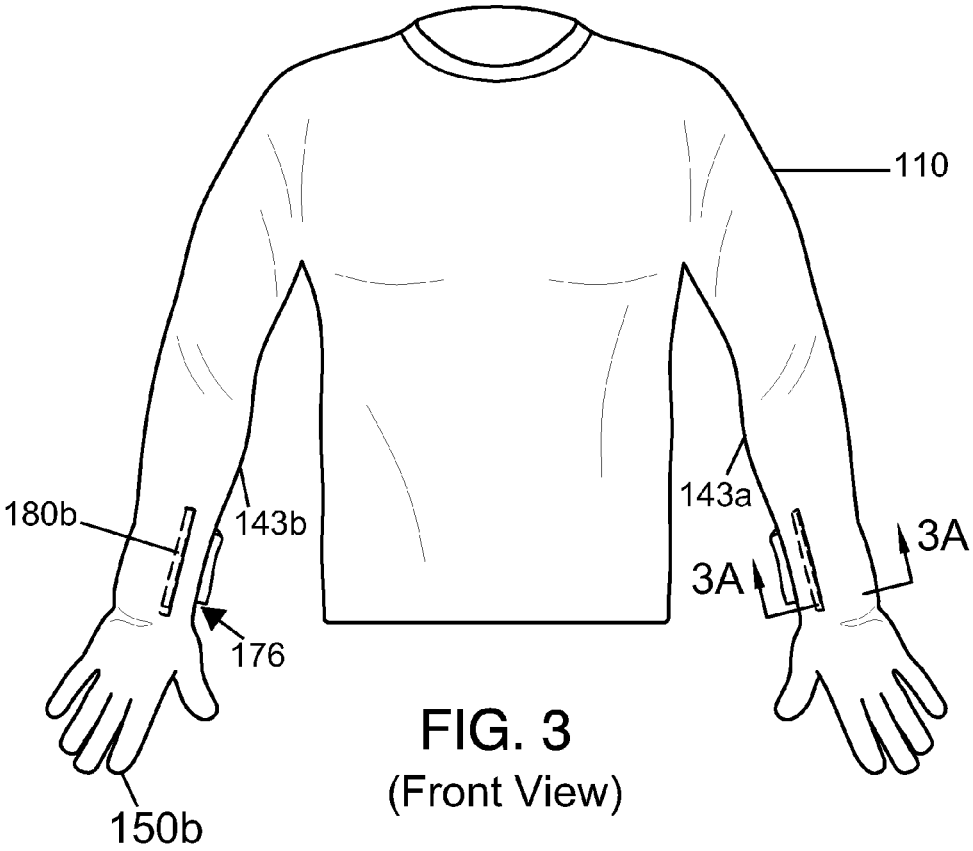
FIG. 3 is a front view of the system of the present invention.
Figure 3A:
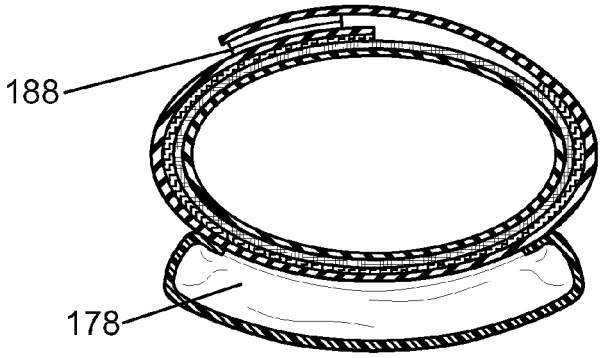
FIG. 3A is a cross-sectional view taken along sleeve section of the system in FIG. 3.
Figure 4:
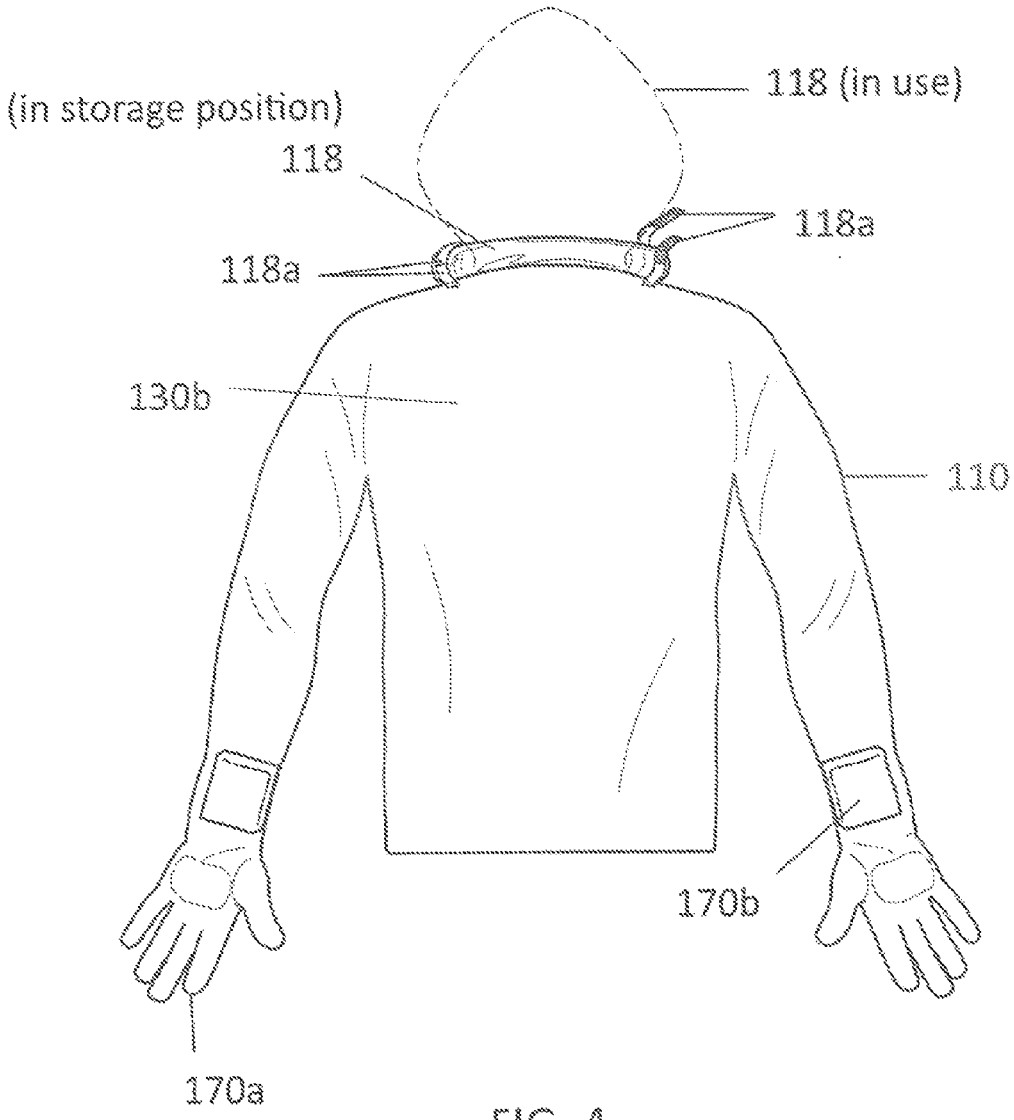
FIG. 4 is a back view of an alternative embodiment of the system of the present invention (a version with a hood).

As shown in FIG. 1, FIG. 1A, FIG. 3, and FIG. 4, the system (100) comprises a shirt component (110) with a front torso section (130*a*), a back torso section (130*b*), a neck hole (120), a first sleeve (140*a*), and a second sleeve (140*b*). As shown in FIG. 1 and FIG. 3, in some embodiments, the shirt component (110) is a pullover type shirt (e.g., without a zipper). As shown in FIG. 1A, in some embodiments, the shirt component (110) comprises a zipper (180). In some embodiments, a zipper (180) may extend from the neck hole (120) downwardly to a bottom edge of the front torso section (130*a*) or to near the bottom edge of the front torso section (130*a*). In some embodiments, a zipper (180) extends from the bottom edge of the front torso section (130*a*) upwardly to the neck hole (120). As shown in FIG. 4, in some embodiments, the shirt component (110) is a jacket style optionally with a hood (118). The hood (118) may be extended for use over the user's head, or the hood (118) may be rolled and stored (in a storage position) at the nape of the user's neck. In some embodiments, the shirt component (110) comprises a hood securing mechanism (118*a*) for securing the hood (118) in the storage position. In some embodiments, the hood securing mechanism (118*a*) is disposed on the shoulder or neck area (e.g., near the neck hole (120)) of the shirt component (110). In some embodiments, the hood securing mechanism (118*a*) comprises a hook-and-loop fastener mechanism, a snap mechanism, a magnet mechanism, a clip mechanism, a clasp mechanism, the like, or a combination thereof. In some embodiments, the hood securing mechanism (118*a*) is arranged as shown in FIG. 4, e.g., two securing mechanisms (118*a*) are disposed on the shirt component (110), one on each side of the neck hole.

A first glove (150*a*) is disposed on the outer end (141*a*) of the first sleeve (140*a*). A second glove (150*b*) is disposed on the outer end (141*b*) of the second sleeve (140*b*). As shown in FIG. 1, the gloves (150) are extensions of the sleeves (140).

A first pocket (170*a*) is disposed on the outer surface of the first sleeve (140*a*) at or near its outer end (141*a*). A second pocket (170*b*) is disposed on the outer surface of the second sleeve (140*b*) at or near its outer end (141*b*). The pockets (170) each have an inner cavity (178) and an opening (176) for allowing access to the inner cavity (178), wherein the opening (176) faces the respective outer end (141) of the respective sleeve (140). In some embodiments, the openings (176) of the pockets (170) can move between an open position and a closed position and can be secured in the closed position via a securing means. Securing means are well known to one of ordinary skill in the art, for example including but not limited to a hook-and-loop fastener mechanism, a zipper mechanism, a button mechanism, a snap mechanism, a clasp mechanism, a magnet mechanism, the like, or a combination thereof.

Figure 2:
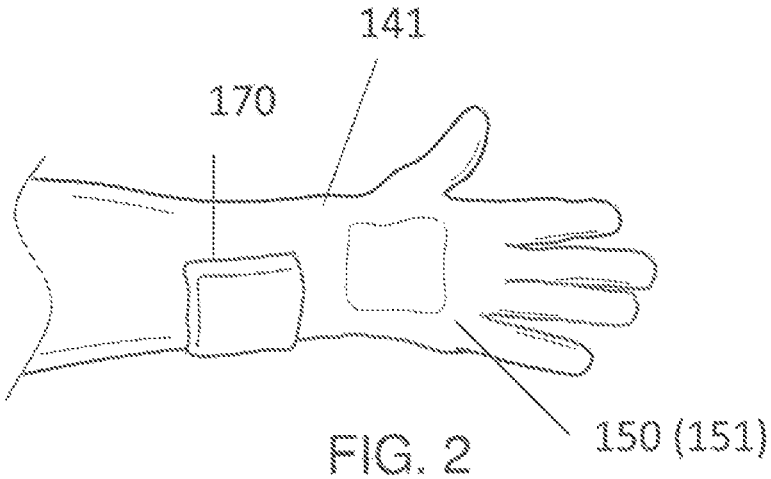
FIG. 2 is a detailed view of the system of the present invention.

In some embodiments, as shown in FIG. 2, the pockets (170) are positioned in line with the palm side (151) of the glove (150), e.g. the pockets (170) are positioned on the inside surface of the sleeve (140). The pockets (170) are not limited to the aforementioned placement and orientation.

A first slit (180*a*) is disposed in the first sleeve (140*a*) adjacent to the first pocket (170*a*). A second slit (180*b*) is disposed in the second sleeve (140*b*) adjacent to the second pocket (170*b*). The slits (180) can move between an open position and a closed position and can be secured in the closed position via a closing means (188). The closing means (188) may include but is not limited to a hook-and-loop fastener mechanism, a zipper mechanism, a button mechanism, a snap mechanism, a clasp mechanism, a magnet mechanism, the like, or a combination thereof.

The slits (180) allow a user to pull his/her hand out of the glove (150) and out of the sleeve (140). For example, if a user wishes to remove the gloves (150) from his/her hands, he/she can open the slit (180) and slide his/her hands out of the gloves (150) and through the slit (180) in the sleeve (140). The gloves (150), since they are an extension of the sleeves (140), remain attached.

Without wishing to limit the present invention to any theory or mechanism, it is believed that the system (100) of the present invention is advantageous because a user's hand can come out of the glove (150) without having to take off the remaining shirt component (110) or letting go of the glove (150). The glove (150) can be temporarily housed in the respective pocket (170).

The system (100) of the present invention may be constructed from a variety of materials. For example, in some embodiments, the system (100), e.g., the shirt component, is constructed from a material comprising a waterproof material, a water-resistant material, and/or the like. Waterproof and water-resistant materials are well known to one of ordinary skill in the art and are commonly used to construct winter coats, rain jackets, ski jackets, and the like. In some embodiments, the system (100), e.g., the shirt component, is constructed from a material comprising nylon, polyester, fleece, cotton, down feather, the like, or a combination thereof.

As used herein, the term 'about' refers to plus or minus 10% of the referenced number.

The disclosures of the following U.S. Patents are incorporated in their entirety by reference herein: U.S. Pat. No. 1,296,966; U.S. Pat. No. 2,136,879; U.S. Pat. No. 2,675,554; U.S. Pat. No. 3,889,297; U.S. Pat. No. 5,073,988; U.S. Pat. No. 5,749,098; U.S. Pat. No. 6,128,785; U.S. Pat. No. 6,237,152; U.S. Design Pat. No. D449,422; U.S. Pat. Application No. 200910049580

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A shirt system (100) for providing protective clothing for a user's torso, hands, wrist, and arms, said shirt system (100) comprising:

(a) a shirt component (110) comprising a front torso section (130*a*) a back torso section (130*b*), a neck hole (120), a first sleeve (140*a*), and a second sleeve (140*b*), the first sleeve (140*a*) has an outer end (141*a*), the second sleeve (140*b*) has an outer end (141*b*), the first sleeve (140*a*) has a first inner side (143*a*) proximal to the front torso section (130*a*), and the second sleeve (140*b*) has a second inner side (143*b*) proximal to the front torso section (130*a*);

(b) a first glove (150*a*) disposed on the outer end (141*a*) of the first sleeve (140*a*), the first glove (150*a*) is an extension of the first sleeve (140*a*), and a second glove (150*b*) disposed on the outer end (141*b*) of the second sleeve (140*b*), the second glove (150*b*) is an extension of the second sleeve (140*b*);

(c) a first pocket (170*a*) disposed on an outer surface of the first sleeve (140*a*) near its outer end (141*a*) and a second pocket (170*b*) disposed on the outer surface of the second sleeve (140*b*) near its outer end (141*b*), the pockets (170) each have an inner cavity (178) and an opening (176) for allowing access to the inner cavity (178), the openings (176) of the pockets (170) face the respective outer end (141) of the respective sleeve (140), the openings (176) of the pockets (170) can move between an open position and a closed position; and (d) a first slit (180*a*) disposed in the first sleeve (140*a*) adjacent to the first pocket (170*a*), and a second slit (180*b*) disposed in the second sleeve (140*b*) adjacent to the second pocket (170*b*), the slits (180) can each move between an open position and a closed position and can be secured in the closed position via a closing means (188), the slits (180) are adapted to allow a user to slide his/her hand and wrist out of the respective glove (150) and sleeve (140), wherein when a user's hand and wrist is through the slit (180), the respective glove (150) can be stored in its respective pocket (170); and (e) a hood (118) disposed at the neck hole (120), the hood (118) can be extended for use over a user's head or rolled and stored in a storage position at the neck hole (120), the hood (118) comprising a hood securing mechanism (118*a*) for securing the hood (118) in the storage position;

wherein the first glove (150*a*) is completely connected to the outer end (141*a*) such that it is a continuous extension of the first sleeve (140*a*), and wherein the second glove (150*b*) is completely connected to the outer end (141*ba*) such that it is a continuous extension of the second sleeve (140*b*);

wherein the first slit (180*a*) is longitudinally disposed on the first sleeve (140*a*) and biased towards the first inner side (143*a*), and wherein the second slit (180*b*) is longitudinally disposed on the second sleeve (140*b*) and biased towards the second inner side (143*b*); and wherein the hood securing mechanism (118*a*) is separated from the hood (118) and disposed on the shirt component (110).

2. The system (100) of claim 1 further comprising a zipper (180) extending from the neck hole (120) downwardly to a bottom edge of the front torso section (130*a*) or to near the bottom edge of the front torso section (130*a*).

3. The system (100) of claim 1 further comprising a zipper (180) extending from a bottom edge of the front torso section (130*a*) upwardly to the neck hole (120).

4. The system (100) of claim 1, wherein the hood securing mechanism (118*a*) comprises a hook-and-loop fastener mechanism, a snap mechanism, a magnet mechanism, a clip mechanism, a clasp mechanism, or a combination thereof.

5. The system (100) of claim 1, wherein the shirt component is constructed from a material comprising a waterproof material.

6. The system (100) of claim 1, wherein the shirt component is constructed from a material comprising a water-resistant material.

7. The system (100) of claim 1, wherein the openings (176) of the pockets (170) can be secured in the closed position via a securing means.

8. The system (100) of claim 1, wherein the pockets (170) are positioned in line with a palm side (151) of the glove (150).

9. The system (100) of claim 1, wherein the closing means (188) comprises a hook-and-loop fastener mechanism, a zipper mechanism, a button mechanism, a snap mechanism, a clasp mechanism, a magnet mechanism, or a combination thereof.

10. A shirt system (100) for providing protective clothing for a user's torso, hands, wrist, and arms, said shirt system (100) consisting of:

(a) a shirt component (110) consisting of a front torso section (130*a*) a back torso section (130*b*), a neck hole (120), a first sleeve (140*a*), and a second sleeve (140*b*), the first sleeve (140*a*) has an outer end (141*a*), the second sleeve (140*b*) has an outer end (141*b*), the first sleeve (140*a*) has a first inner side (143*a*) proximal to the front torso section (130*a*), and the second sleeve (140*b*) has a second inner side (143*b*) proximal to the front torso section (130*a*);

(b) a first glove (150*a*) disposed on the outer end (141*a*) of the first sleeve (140*a*), the first glove (150*a*) is an extension of the first sleeve (140*a*), and a second glove (150*b*) disposed on the outer end (141*b*) of the second sleeve (140*b*), the second glove (150*b*) is an extension of the second sleeve (140*b*);

(c) a first pocket (170*a*) disposed on an outer surface of the first sleeve (140*a*) near its outer end (141*a*) and a second pocket (170*b*) disposed on the outer surface of the second sleeve (140*b*) near its outer end (141*b*), the pockets (170) each have an inner cavity (178) and an opening (176) for allowing access to the inner cavity (178), the openings (176) of the pockets (170) face the respective outer end (141) of the respective sleeve (140), the openings (176) of the pockets (170) can move between an open position and a closed position; and (d) a first slit (180*a*) disposed in the first sleeve (140*a*) adjacent to the first pocket (170*a*), and a second slit (180*b*) disposed in the second sleeve (140*b*) adjacent to the second pocket (170*b*), the slits (180) can each move between an open position and a closed position and can be secured in the closed position via a closing means (188), the slits (180) are adapted to allow a user to slide his/her hand and wrist out of the respective glove (150) and sleeve (140), wherein when a user's hand and wrist is through the slit (180), the respective glove (150) can be stored in its respective pocket (170); and (e) a hood (118) disposed at the neck hole (120), the hood (118) can be extended for use over a user's head or rolled and stored in a storage position at the neck hole (120), the hood (118) consisting of a hood securing mechanism (118*a*) for securing the hood (118) in the storage position;

wherein the first glove (150*a*) is completely connected to the outer end (141*a*) such that it is a continuous extension of the first sleeve (140*a*), and wherein the second glove (150*b*) is completely connected to the outer end (141*ba*) such that it is a continuous extension of the second sleeve (140*b*);

wherein the first slit (180*a*) is longitudinally disposed on the first sleeve (140*a*) and biased towards the first inner side (143*a*), and wherein the second slit (180*b*) is longitudinally disposed on the second sleeve (140*b*) and biased towards the second inner side (143*b*); and wherein the hood securing mechanism (118*a*) is separated from the hood (118) and disposed on the shirt component (110).

* * * * *